United States Patent [19]

Teodoridis et al.

[11] Patent Number: 4,884,252

[45] Date of Patent: Nov. 28, 1989

[54] TIMEPIECE INCLUDING AN ANTENNA

[75] Inventors: Viron Teodoridis, Hauterive; Bernard Joss, Chézard, both of Switzerland

[73] Assignee: ETA SA Fabriques d'Ebauches, Grenchen, Switzerland

[21] Appl. No.: 338,192

[22] Filed: Apr. 14, 1989

[30] Foreign Application Priority Data

Apr. 26, 1988 [CH] Switzerland ..... 1563/88

[51] Int. Cl.[4] ..... G04B 47/00

[52] U.S. Cl. ..... 368/10; 368/281; 455/344

[58] Field of Search ..... 368/10, 276, 278, 282–282; 455/344–351

[56] References Cited

U.S. PATENT DOCUMENTS

| | | | |
|---|---|---|---|
| 3,631,500 | 12/1971 | Itoh | 343/725 |
| 4,419,770 | 12/1983 | Yagi et al. | 455/301 |
| 4,482,255 | 11/1984 | Gygax et al. | 368/10 |

FOREIGN PATENT DOCUMENTS

| | | | |
|---|---|---|---|
| 1307381 | 9/1962 | France . | |
| 52-48363 | 10/1977 | Japan . | |
| 55-106380 | 8/1980 | Japan | 368/10 |
| 58-52591 | 3/1983 | Japan | 368/10 |

*Primary Examiner*—Vit W. Miska

*Attorney, Agent, or Firm*—Griffin, Branigan & Butler

[57] ABSTRACT

A timepiece (4), adapted to be worn on a part of the body, for example on the wrist, is provided with an antenna capable of capturing an electromagnetic field bearing radio-diffused messages. Measurements have shown that when close to the wrist the radial electric component ($E_r$) and the azimuthal or tangential magnetic component ($H_\phi$) were predominant. Consequently, in order to capture the first, a capacitive antenna the electrodes of which are parallel to the back cover (2) of the timepiece will be provided and, to capture the second, an inductive antenna including a winding the axis of which is parallel to the longitudinal direction of the bracelet (3) will be provided.

9 Claims, 4 Drawing Sheets

TIMEPIECE INCLUDING AN ANTENNA

This invention concerns a timepiece adapted to be worn on a part of the body having a cylindrical form such as the arm or the trunk, said timepiece including an antenna capable of capturing an electromagnetic field bearing radio diffused messages and a case having at least a glass and a back cover, said case comprising in addition to the elements necessary to displaying the time of day, a micro receiver receiving messages captured by the antenna in order to transform such messages into data perceptible to the timepiece wearer.

BACKGROUND OF THE INVENTION

On many occasions, timepieces have been presented equipped with an antenna and a micro receiver in order to capture radio diffused signals. If such timepiece is in the form of a wristwatch, the antenna is generally located within the bracelet as is the case in arrangements described for instance in the patent documents Nos. FR-A-1 207 640, EP-A-0 100 639, EP-A-0 125 930, EP-A-0 184 606 and WO-A-86/03645. But locating the antenna within the bracelet of a watch gives rise to problems of providing connections between the input to the receiver located in the watchcase and the antenna which forms a part of the bracelet, this latter a movable element, generally hinged on the case by means of lugs. The leadthrough of the antenna conductor thus gives rise to constructional problems which require solutions not always simple. At the leadthrough for instance the conductors are mechanically stressed and they break off more or less rapidly if means are not provided to avoid such breakage. The means are demanding and complicate changing the bracelet, a bracelet moreover which must be specially built since it carries an antenna and which may not always be exchanged with a bracelet readily found on the market.

To incorporate a micro receiver with its antenna within a case worn by a person, is known from relatively recent developments. There is for instance a receiver developed by the Motorola company and confined to a case in the form of a pen provided with a clip which serves to attach the pen to a portion of the clothing. Such a product has been made known under the registered trademark "Sensar". There is likewise known a receiver from the Philips company which takes the form of an elongated parallelepipedon likewise provided with a clip enabling it to be attached to an article of clothing. This receiver is known as the "Pager 32 B" and its approximate dimensions are 10 cm in length and 2 cm in width and thickness.

The receivers just mentioned have dimensions sufficiently great so that incorporation of an antenna does not pose very grave problems. However, it seems admissible that to incorporate an antenna into the case of a timepiece capable of being worn on a portion of the body, for example a wristwatch or a pendant watch, poses problems far more difficult to solve in view of the very limited space which is available for mounting such antenna.

Efforts have however been made in order to resolve this problem. Thus, the French patent document No. FR-A-2 505 105 (U.S. Pat. No. 4,419,770) describes a wrist AM radio receiver including a PLL synthesizer as local oscillator. This receiver, provided with an electronic watch, is equipped with an antenna in the form of bar mounted in the watchcase, such case being rounded in order to hug the curve of the wrist. The figures accompanying the document show clearly that the bar is directed in the sense of the width of the bracelet, this making the antenna sensitive to the component of the magnetic field situated longitudinally to the cylinder which forms the wrist. This arrangement is unfavourable as will appear in the description of the invention to follow.

The English abstract of the patent document No. JP-A-52-48 364 appearing in "Patent Abstracts of Japan", vol. 1, Nr. 116, Oct. 4, 1977, page 4486 E77, describes a timepiece under the glass of which is placed a single line antenna. It has been however determined that such an antenna is inefficient in the range of frequencies considered hereinafter, if it is not associated with another conducting element in order to form a capacitive antenna sensitive to the component of the electrical field located radially to the cylinder which forms the wrist.

SUMMARY OF THE INVENTION

In order to obtain a reasonable signal at the input of the micro receiver, it is thus necessary to take certain precautions to attain the objective of this invention, such invention being characterized in that the antenna is arranged and directed to capture either the component $H_\phi$ of the magnetic field H located tangentially to the cylinder formed by the portion of the body on which the watch is worn, or the component $E_r$ of the electrical field E located radially to said cylinder, or eventually said components $H_\phi$ and $E_r$ in combination.

The invention will be better understood following reading of the description to follow and in referring to the drawings which illustrate it by way of example.

DESCRIPTION OF THE PREFERRED EMBODIMENT

Laws are known which determine the propagation of the electromagnetic field in a vacuum. They are expressed by the Maxwell equations which couple the magnetic and electrical components of the electromagnetic field, these components being orthogonal to one another. These equations teach that an electrical field variable over a period of time generates a rotating magnetic field and inversely. There results from this that the electrical component of the field may be captured by a capacitive antenna while the magnetic component may be captured by an inductive antenna. A capacitive antenna takes the form of two electrodes separated by a dielectric and an inductive antenna takes the form of a coil. By dielectric there must here be understood an insulating medium separating the two electrodes, which medium may also be air. The polarization of the incident electrical field is assumed to be perpendicular to the electrodes of the capacitive antenna while the incident polarization of the magnetic field is assumed to be parallel to the axis of the coil of the inductive antenna.

This invention relating to a timepiece adapted to be worn on a part of the human body, it is very important to know the influence of the body on the configuration of the electromagnetic field. It has been determined that for frequencies situated in the VHF band (30 to 300 MHz) and at least at the beginning of the UHF band (300 to 3000 MHz), the level and direction of the electromagnetic field are strongly modified in the neighbourhood of the body, this being mainly due to the fact that the dielectric properties of the human body are very different from those of air.

Figure 1:
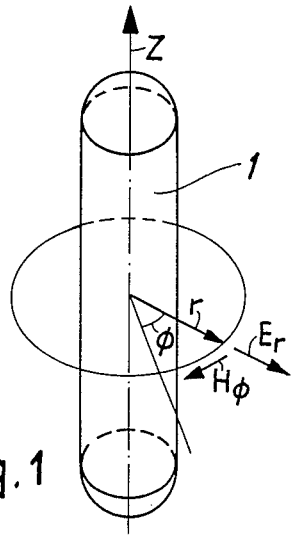
FIG. 1 is a schematic view simulating the human body or a part thereof and shows two components of the electromagnetic field in proximity to such body.

A study of the electromagnetic field in the neighbourhood of the human body has been undertaken in forming a model of this body as shown on FIG. 1. The model is a cylinder 1 having a height of 180 cm and a diameter of 25 cm. The material of this body is simulated by a solution of glycol ethandiol, distilled water and sodium chloride proportioned such that the dielectric properties of this solution correspond to those of the body.

Numerous measurements effected within the framework of this invention have enabled the establishment of the three following conclusions if one radiates the model by a vertical polarization field:

at a distance $r<15$ cm from the surface of the body, the electrical field is essentially radial, i.e. perpendicular to the skin. This electrical field will be referred to by $E_r$.

At a distance $r<15$ cm from the surface of the body, the magnetic field is essentially azimuthal or tangential, i.e. turning around the body. This magnetic field will be referred as $H_\phi$.

The components $E_r$ and $H_\phi$ of the electromagnetic field are almost independent of the angle $\phi$, this implying a radiation almost omnidirectional in the plane perpendicular to the body.

The term "essentially" employed hereabove leaves it to be understood that there exist other directions of the electromagnetic field than those considered for which one measures values of lesser amplitude than those of the privileged directions $E_r$ and $H_\phi$. These are in particular the radial and longitudinal directions for the magnetic field and the tangential and longitudinal directions for the electrical field, the longitudinal direction being that which is parallel to the Z axis of the body. Thus, to take a concrete example, there has been measured a level of tangential magnetic field $H_\phi$ of 6 to 8 dB greater than the level exhibited by the radial magnetic field.

Similar measurements to those which have been mentioned hereabove have been repeated not only on the human body or trunk but on the forearm or wrist for several positions of the arm relative to the body. All positions with one exception have given results which are identical to the results obtained precedingly and have thus confirmed the dominance of the fields $E_r$ and $H_\phi$ for the wrist as well. The position which gives rise to the exception is that where the arm is folded against the chest. In this special case it is the longitudinal component of the magnetic field which dominates since there is a coupling with the tangential component $H_\phi$ brought about by the trunk of the body. In this particular case however the component $E_r$ remains.

From the important considerations which precede, there follows immediately the attainment of the main objective of this invention in respect of the manner of incorporating an antenna into a timepiece intended to be worn on a part of the body, whether this be the trunk or the forearm of the body, namely the antenna must be arranged and directed in order to capture either the magnetic component $H_\phi$ of the electromagnetic field located tangentially to the cylinder representing the body or a portion thereof, or the electrical component $E_r$ of the same electromagnetic field located radially to said cylinder.

Figure 2:
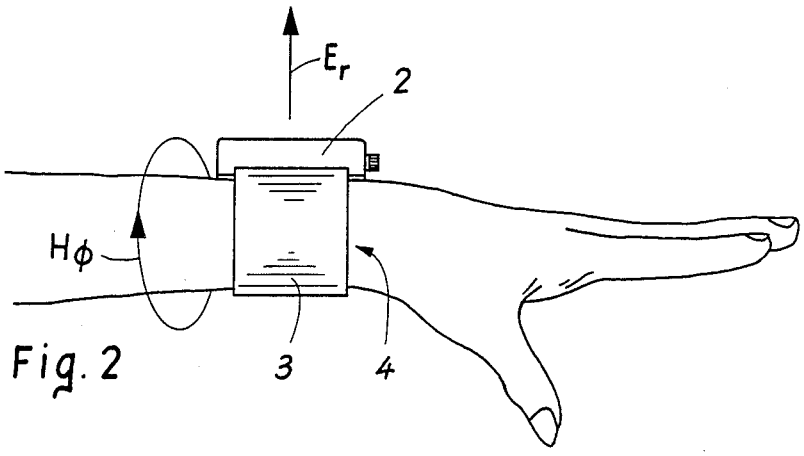
FIG. 2 shows a wrist bearing a wristwatch as well as two components of the electromagnetic field acting on such watch.

FIG. 2 shows a forearm bearing a wristwatch 4 including a case 2 and a bracelet 3. The two predominant fields $E_r$ (radial electrical component) and $H_\phi$ (azimuthal or tangential magnetic component) act on this case.

Figure 5:
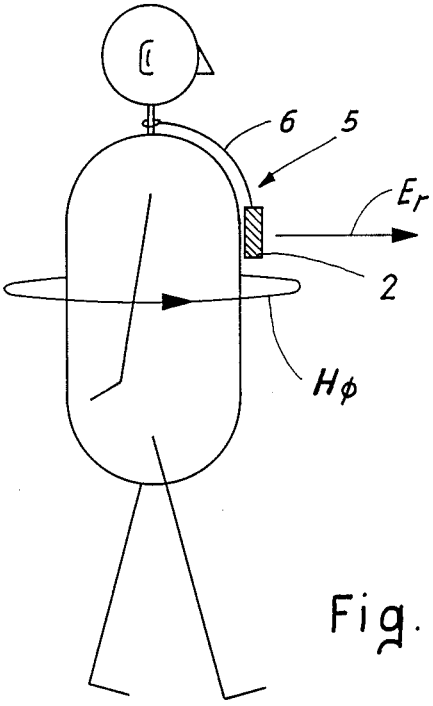
FIG. 5 shows a man wearing a pendant watch as well as two components of the electromagnetic field acting on such watch.

FIG. 5 shows a human figurine wearing a pendant watch 5 including a case 2 attached to a chain 6. The two predominant fields $E_r$ and $H_\phi$ likewise act on this case.

It will be understood that in the two examples of FIGS. 2 and 5, the tangential magnetic field $H_\phi$ penetrates into the case by the cross-section of the latter and that the antenna to be provided must be formed of a coil having one or several windings, the axis of this coil being arranged parallel to the back cover of the case.

Figure 3:
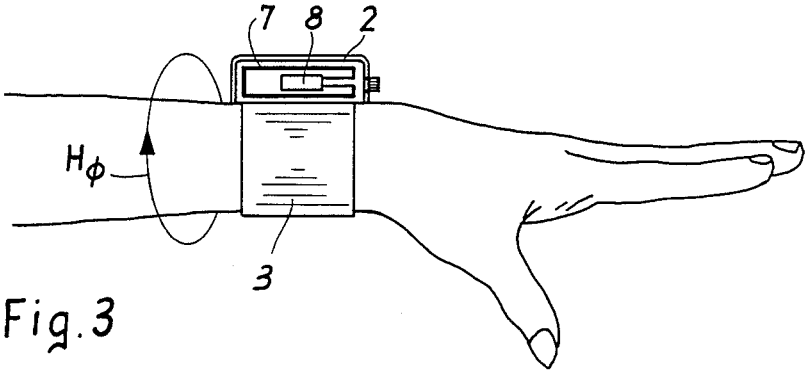
FIG. 3 shows how an inductive antenna is arranged in the wrist of the invention.

In the example of the wristwatch, FIG. 3 shows in a schematic manner how the inductive antenna is arranged in the case 2 of the watch. The antenna 7 here comprises only a single winding which is connected to a micro receiver 8. It is important to note that in this instance the axis of the coil in addition to being arranged parallel to the back cover of the case, must be arranged parallel to the longitudinal direction of the bracelet 3.

In the example of the pendant watch, FIG. 5 makes it apparent that the axis of the inductive antenna, not shown, in addition to being necessarily arranged parallel to the back cover of the case, must be arranged perpendicular to the vertical of a plumb line.

This first embodiment of the invention which consists in capturing the tangential magnetic component of the electromagnetic field and which has been explained hereinabove in principle, is illustrated by a practical embodiment shown on FIGS. 6 and 7.

Figure 6:
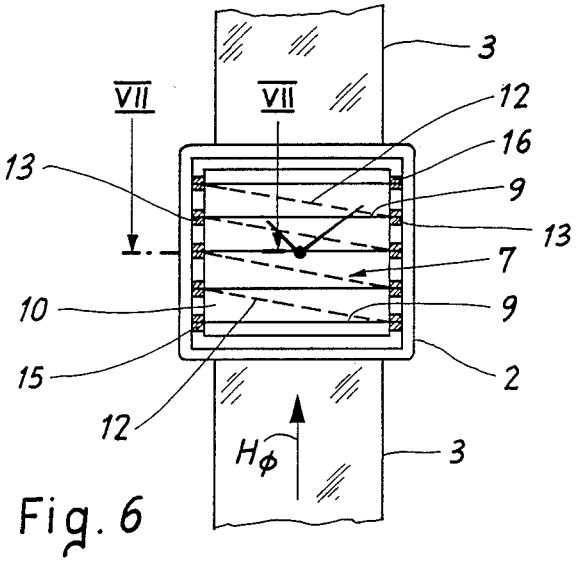
FIG. 6 is a top view of a wristwatch according to a first embodiment of the invention.
Figure 7:
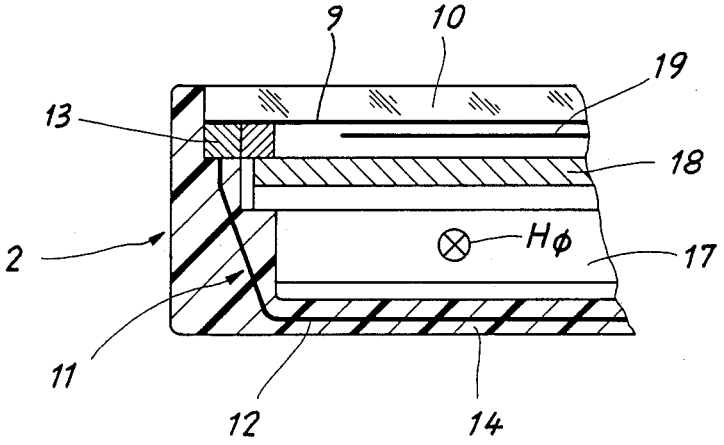
FIG. 7 is a cross-section along line VII—VII of FIG. 6.

FIG. 6 is a plan view of a wristwatch comprising a case 2 and a bracelet 3 and FIG. 7 is a cross-section along line VII—VII of FIG. 6. This watch is subjected to the tangential magnetic component $H_\phi$. In order to capture this component, the watch includes an inductive antenna 7 here formed of five windings 11, each having two sections 9 and 12 coupled end to end by means of connections 13. As shown on FIG. 7, the first section 12 is a metallic wire sunk into the back cover 14 of case 2 and the second section 9 is in the form of metallization deposited under the glass 10. These first and second sections are here connected end to end by means of a flexible connector 13 which may consist of a "zebra" (registered trademark) bearing several conductive zones. Zones 15 and 16 of the connector 13 are coupled to the input of a micro receiver (not shown) which is arranged within case 2 in addition to all the elements necessary for displaying the time of day such as the movement 17, the dial 18 and hands 19. The battery for energization of the system may be housed in a drawer provided laterally within the case or in an opening provided in the back cover. In this latter case the sections 12 will traverse the cover of the opening and will be coupled to the sections sunk into the back cover likewise by means of flexible connectors.

The invention is not limited to the specific embodiment described hereinabove. Thus, the connections coupling the sections to one another could be in the form of soldering or welds rather than the connectors as suggested. The metallized section 9 could also be over the glass or sunk into the latter. In the same manner, section 12 could be only partially sunk into the back cover 14 or even arranged on the surface thereof.

FIGS. 2 and 5 also show that the radial electrical field $E_r$ penetrates the case perpendicularly to its glass or to its back cover and that in this case the antenna to be provided for the capture thereof will necessarily be constituted by two substantially planar electrodes separated by a dielectric and arranged parallel to the back cover of the case.

Figure 4:
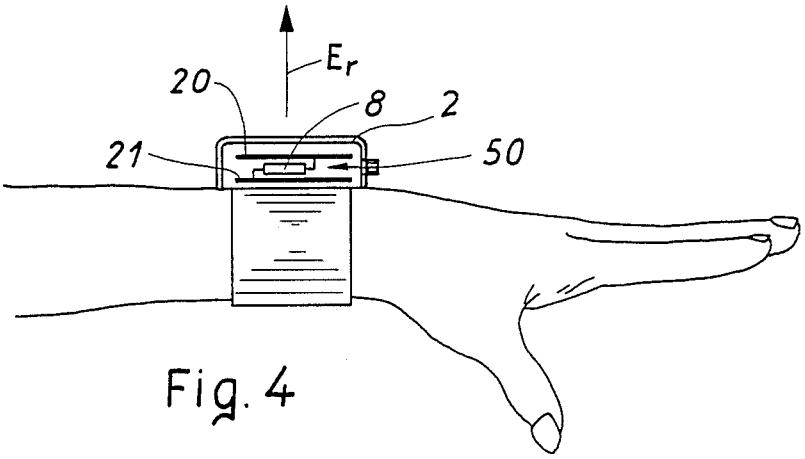
FIG. 4 shows how a capacitive antenna is arranged in the wristwatch of the invention.

In the example of the wristwatch, FIG. 4 shows in a schematic manner how the capacitive antenna 50 is arranged in the case 2. Here the antenna includes two electrodes 20 and 21 connected to a micro receiver 8.

In the example of the pendant watch, it is apparent from FIG. 5 that the electrodes (not shown) will also necessarily be arranged parallel to the glass or to the back cover of the case.

Figure 8:
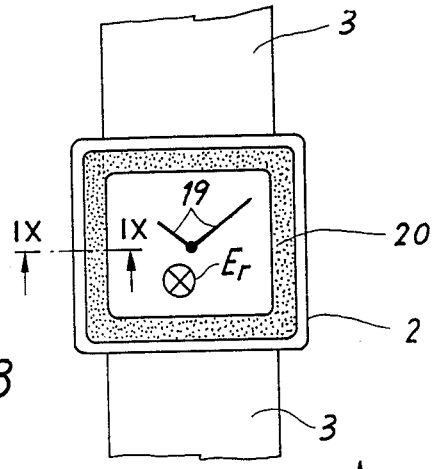
FIG. 8 is a top view of a wristwatch according to a second embodiment of the invention.
Figure 9:
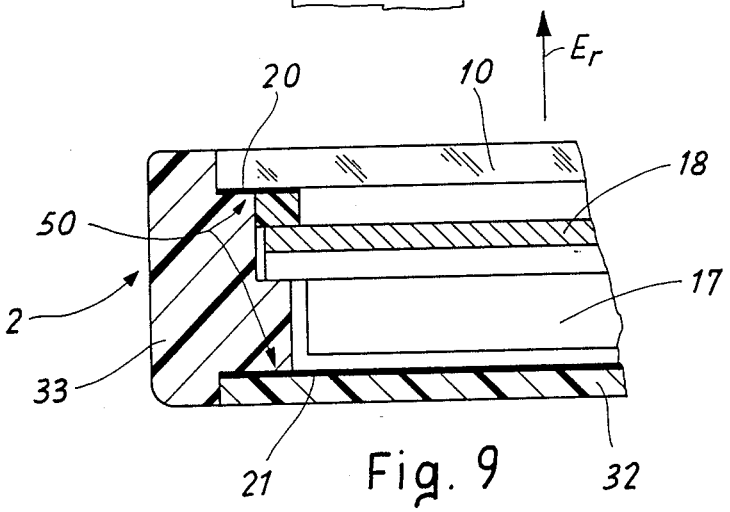
FIG. 9 is a cross-section along line IX—IX of FIG. 8.

The second embodiment of the invention which consists of capturing the radial electrical component of the electromagnetic field is illustrated by a practical arrangement shown by FIGS. 8 and 9.

FIG. 8 is a plan view of a wristwatch including a case 2 and a bracelet 3, and FIG. 9 is a cross-section along line IX—IX of FIG. 8. This watch is subjected to the radial electrical component $E_r$. In order to capture this component the watch includes a capacitive antenna formed from electrodes 20 and 21. The first electrode is a peripheral metallization 20 of glass 10 and the second electrode is a metallic back cover 21 which may be entirely metallic, or as shown on FIG. 9, a metal leaf applied to a cover 32 formed of plastic material. Thus, electrodes 20 and 21 are arranged parallel to one another so as to capture the radial electrical component $E_r$ of the electromagnetic field. The electrodes are supported on a caseband 33 formed of insulating material. Electrodes 20 and 21 are coupled to the input of a micro receiver (not shown) which is arranged in the case 2 in addition to all other elements required for displaying the time of day such as movement 17, dial 18 and hands 19. The connections between electrodes 20 and 21 and the input of the micro receiver could be obtained by spring loaded supports such as already described for instance in the patent No. EP-B-0 041 145 (U.S. Pat. No. 4,523,856).

The invention is not limited to the special embodiment as described hereinabove, the essential being that electrode 20 must be located at a certain distance from electrode 21 and exhibit a certain surface relative to the latter. Thus, electrode 20 could have a surface substantially identical to that of electrode 21 if it were located under dial 18. In certain cases, this electrode 20 could be the dial itself surmounted by hands and eventually pierced with an opening so as to permit appearance for example of the message to be transmitted (a telephone number to call back, date of a meeting, etc.). In the same manner, the annular electrode 20 shown on FIG. 8 could be split or assume a serpentine form.

Figure 10:
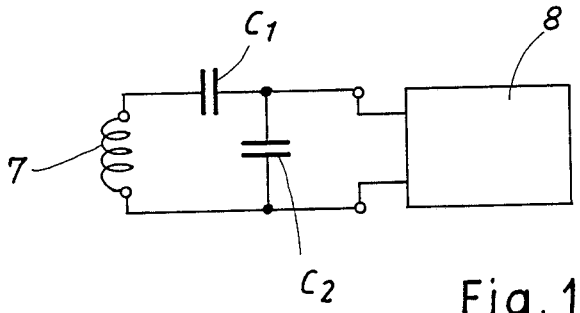
FIG. 10 is a simplified electrical schematic diagram showing an example of matching of the antenna to a micro receiver.

FIG. 10 shows a schematic diagram of the possible matching of an inductive antenna 7 to the input of a micro receiver 8. This receiver may be that marketed by the Philips Company under the reference UAA 2033. If the inductive antenna comprises five windings and is balanced, the matching at the input of the receiver will take the form of capacitors $C_1$ and $C_2$, the capacity of each being on the order of 4 pF. Other arrangements are likewise possible in accordance with whether the antenna and the receiver input are matched or not.

It has been seen how one captures the magnetic component $H_\phi$ or the electrical component $E_r$ of the electromagnetic field respectively by means of an inductive or a capacitive antenna. It is evident that the present invention is not limited to the capture of one of these components whilst excluding the other and that one could readily capture both components at the same time, one thereof not propagating without the other. In this case one would provide the timepiece with a capacitive antenna and an inductive antenna obtained in accordance with the description given hereinabove. It will be understood that such an arrangement could be advantageous in respect of the amplitude of the signal gathered in. It will also be understood that if two antennas are placed in parallel one of them may serve as matching circuit for the other this leading to a simplification of the input circuit of the micro receiver.

What we claim is:

1. A timepiece adapted to be worn on a portion of the body having a cylindrical form such as the arm or the trunk, said timepiece including an antenna capable of capturing an electromagnetic field which includes a magnetic field H and an electrical field E, said electromagnetic field bearing radio-diffused messages and a case having at least a glass and a back cover, said case comprising, in addition to the elements necessary to display the time of day, a micro receiver which receives the messages captured by the antenna in order to transform such messages into data perceptible to the wearer of the timepiece; the antenna being situated within the space bounded by the case and being constituted by a coil including at least one winding said winding being arranged and oriented to capture the component ($H_\phi$) of the magnetic field tangential to said cylinder, the axis of said winding being arranged parallel to the back cover of the case.

2. A timepiece as set forth in claim 1 in the form of a wristwatch having a bracelet, the axis of said winding being furthermore oriented parallel to the longitudinal direction of the bracelet.

3. A timepiece as set forth in claim 1 in the form of a pendant watch, the axis of said winding being furthermore oriented perpendicularly to the vertical of a plumb line.

4. A timepiece as set forth in claim 1 wherein the winding includes a plurality of sections coupled end to end by connections.

5. A timepiece as set forth in claim 4 wherein the winding includes a first section sunk into the back cover of the case and a second section metallized under the glass, the first and second sections being coupled end to end by means of flexible connectors located between the back cover and the glass.

6. A timepiece adapted to be worn on a portion of the body having a cylindrical form such as the arm or the trunk, said timepiece including an antenna capable of capturing an electromagnetic field which includes a magnetic field H and an electrical field E, said electromagnetic field bearing radio-diffused messages and a case having at least a glass and a back cover, said case comprising, in addition to the elements necessary to display the time of day, a micro receiver which receives the messages captured by the antenna in order to transform such messages into data perceptible to the wearer of the timepiece, the antenna being situated within the space bounded by the case and being formed by first and second substantially planar electrodes placed parallel to one another and separated by a dielectric, said electrodes being arranged and oriented so as to capture the component $E_r$ of the electrical field E radial to said cylinder, the planes of said electrodes being parallel to the back cover of said case.

7. A timepiece as set forth in claim 6 in the form of a wrist watch or pendant watch and including metallization applied under the glass to constitute said first electrode, the back cover and the glass being supported on a caseband formed of insulating material.

8. A timepiece adapted to be worn on a portion of the body having a cylindrical form such as the arm or the trunk, said timepiece including an antenna capable of capturing an electromagnetic field which includes a magnetic field H and an electrical field E, said electromagnetic field bearing radio-diffused messages and a case having at least a glass and a back cover, said case comprising, in addition to the elements necessary to display the time of day, a micro receiver which receives the messages captured by the antenna in order to transform such messages into data perceptible to the wearer of the timepiece, the antenna being situated within the space bounded by the case and formed by the combination of a coil including at least one winding, said coil being arranged and oriented so as to capture the component $H_\phi$ of the magnetic field H tangential to said cylinder, the axis of said coil being arranged parallel to the back cover of said case and of first and second electrodes substantially planar placed parallel to one another and separated by a dielectric, said electrodes being arranged and oriented so as to capture the component $E_r$ of the electrical field radial to said cylinder, the planes of said electrodes being arranged parallel to the back cover of said case.

9. A timepiece as set forth in claim 8 wherein the coil and the first and second electrodes are connected in parallel.

* * * * *